US007210936B2

(12) United States Patent
Moeller et al.

(10) Patent No.: US 7,210,936 B2
(45) Date of Patent: May 1, 2007

(54) MULTIPURPOSE ORGANIZER SYSTEM AND FOLDER WITH PLANNER AND/OR WRITING SURFACE AND STORAGE POCKETS

(75) Inventors: Amy Sue Moeller, Cincinnati, OH (US); Jayne Elizabeth Moening, Cincinnati, OH (US)

(73) Assignee: The Assistant Product Group, Inc., Cincinnati, OH (US)

( * ) Notice: Subject to any disclaimer, the term of this patent is extended or adjusted under 35 U.S.C. 154(b) by 225 days.

(21) Appl. No.: 10/453,161

(22) Filed: Jun. 3, 2003

(65) Prior Publication Data

US 2004/0020813 A1 Feb. 5, 2004

Related U.S. Application Data

(60) Provisional application No. 60/399,784, filed on Jul. 31, 2002.

(51) Int. Cl.
*G09B 25/00* (2006.01)

(52) U.S. Cl. ..... 434/80; 434/73

(58) Field of Classification Search ..... 281/15.1, 281/21.1, 29, 31, 38, 39, DIG. 1; 402/70, 402/73, 79; 434/72, 73, 79, 80
See application file for complete search history.

(56) References Cited

U.S. PATENT DOCUMENTS

| | | | |
|---|---|---|---|
| 403,928 | A | 5/1889 | Emeric |
| 1,219,544 | A | 3/1917 | Gareis |
| 1,348,085 | A | 7/1920 | Cathcart |
| 2,878,586 | A | 3/1959 | Ohlsson |
| 2,941,314 | A | 6/1960 | Schwieger |
| 3,749,211 | A | 7/1973 | Cima |
| 3,789,897 | A | 2/1974 | Saito |
| 3,904,003 | A | 9/1975 | Margerum |
| 4,207,937 | A | 6/1980 | Sandeman et al. |

(Continued)

*Primary Examiner*—Luan K. Bui
(74) *Attorney, Agent, or Firm*—Jagtiani + Guttag; Eric W. Guttag

(57) ABSTRACT

An organizer system comprising: (A) an organizer folder having front and back covers, optionally at least one page positioned between the front and back covers and at least one of the following components associated with at least one surface of the front or back covers or the at least one page: (1) a planner having planning diagram associated with the at least one surface, and at least one object that is repositionable on the planning diagram; or (2) at least one pocket for storing materials; (B) a self-standing folder holder having a receptacle for receiving at least one folder in a stored configuration; and (C) a carrier having a receptacle for receiving at least one holder in a stored configuration and a handle for grasping by the user. The organizer folder can be used with the organizer system, or separate from the organizer system, and can comprise: (1) a front cover; (2) a back cover; (3) optionally at least one page positioned between the front and back covers; (4) a planner associated with at least one side of the front cover, the back cover or the at least one page, and comprising a planning diagram associated with the at least one side, and optionally at least one object that is repositionable on the planning diagram, or at least one erasable writing surface; and (5) at least one pocket for storing materials associated with at least one side of the front cover, the back cover or the at least one page.

10 Claims, 7 Drawing Sheets

U.S. PATENT DOCUMENTS

| | | | | | |
|---|---|---|---|---|---|
| 4,294,348 | A | | 10/1981 | Hastings | |
| 4,463,848 | A | | 8/1984 | Parker | |
| 4,519,629 | A | | 5/1985 | Podosek | |
| 4,652,239 | A | | 3/1987 | Brimberg | |
| 4,795,287 | A | | 1/1989 | Friedman | |
| 4,822,179 | A | | 4/1989 | Nattrass | |
| 4,902,229 | A | | 2/1990 | Pedersen et al. | |
| 4,936,454 | A | | 6/1990 | Wang | |
| 5,012,586 | A | | 5/1991 | Ashworth | |
| 5,042,841 | A | | 8/1991 | Friedman | |
| 5,170,889 | A | | 12/1992 | Cue | |
| 5,193,681 | A | | 3/1993 | Lievsay | |
| 5,269,524 | A | | 12/1993 | Womack | |
| 5,294,208 | A | * | 3/1994 | Tremmel et al. | 402/70 |
| 5,297,814 | A | * | 3/1994 | Peters | 281/45 |
| 5,320,275 | A | | 6/1994 | Williams | |
| 5,348,347 | A | * | 9/1994 | Shink | 281/31 |
| 5,351,992 | A | * | 10/1994 | Chilson et al. | 281/31 |
| 5,505,620 | A | * | 4/1996 | Barlett | 434/80 |
| 5,518,315 | A | | 5/1996 | Nichols | |
| 5,588,528 | A | | 12/1996 | Ozeki | |
| 5,601,431 | A | * | 2/1997 | Howard | 434/80 |
| 5,653,471 | A | * | 8/1997 | Koehn | 281/15.1 |
| 5,680,914 | A | | 10/1997 | Reiser | |
| 5,743,407 | A | | 4/1998 | Williams | |
| 5,820,383 | A | * | 10/1998 | Levins | 281/15.1 |
| 5,924,736 | A | | 7/1999 | Russo | |
| 5,954,170 | A | | 9/1999 | Chisholm | |
| 6,000,724 | A | * | 12/1999 | Holway | 281/31 |
| 6,193,118 | B1 | | 2/2001 | Kearl | |
| 6,217,074 | B1 | * | 4/2001 | Conley, Jr. | 281/15.1 |
| 6,244,400 | B1 | | 6/2001 | Bowers | |
| 6,283,183 | B1 | | 9/2001 | Cooper | |
| 6,341,894 | B1 | | 1/2002 | Quinones | |
| 6,379,156 | B1 | | 4/2002 | Laravea et al. | |
| 6,439,572 | B1 | | 8/2002 | Bowen | |
| 6,464,507 | B1 | | 10/2002 | Bailey | |
| 6,472,037 | B1 | | 10/2002 | Kane | |
| 2001/0020618 | A1 | | 9/2001 | Kellogg et al. | |
| 2001/0047945 | A1 | | 12/2001 | Scherer | |

* cited by examiner

MULTIPURPOSE ORGANIZER SYSTEM AND FOLDER WITH PLANNER AND/OR WRITING SURFACE AND STORAGE POCKETS

CROSS REFERENCE TO RELATED APPLICATIONS

This application claims the benefit of copending U.S. Provisional Patent Application Ser. No. 60/399,784, filed Jul. 31, 2002.

TECHNICAL FIELD

This invention relates to a multipurpose organizer system useful for various task, jobs or projects, including decorating, wedding planning, business and office management, accounting, gardening, landscaping, party planning, coaching and managing athletic teams and the like. This invention also relates to a unique organizer folder that can be used with, or separately from, this organizer system.

BACKGROUND OF THE INVENTION

A variety of organizer systems and organizer devices are known in the art and are provided with various pockets for storing materials, useful tools, paper, and the like. A number of these systems and devices have been developed for specific tasks, jobs or projects. For example, organizers have been developed for planning weddings. See U.S. Pat. No. 5,924,736 to Russo, issued Jul. 20, 1999. Another example is color reference systems for decorating. See U.S. Pat. No. 5,743,407 to Williams, issued Apr. 28, 1998. Organizing systems have also been developed for sorting and organizing coupons. See U.S. Pat. No. 4,463,736 to Parker, issued Aug. 7, 1984.

Some of these organizer systems and devices are of a more general nature. For example, U.S. Pat. No. 3,904,003 to Margerum, issued Sep. 9, 1975, discloses a combination carrying case and traveling desk having a handle 30 for carrying it and which has an accordion file 42 with pockets 43 (plus pockets 54 for cover flaps 20 and 21) for storing various items. Another example is the portable file case disclosed in U.S. Pat. No. 4,936,454 (Wang), issued Jun. 26, 1990, which allows for the stored files 6 or lining structure 5 having a plurality of compartments 51 to be removed from case 2 and is provided with a handle 12 that can be gripped by the user for carrying it. Yet another example is the combination organizer and accordion file disclosed in U.S. Pat. No. 5,954,170 (Chisolm), issued Sep. 21, 1999, that is provided with carrying handles 36 and 38, and which has built in pockets and storage areas 52, 58, 62 and 64, as well as an accordion file 40 with dividers 44.

Organizer handbags are also known in the art. For example, U.S. Pat. No. 6,283,183 to Cooper, issued Sep. 4, 2001, discloses an organizer handbag provided with a loop strap for carrying over the shoulder, as well as various interior and exterior pockets and compartments for storing keys, pagers, cosmetic pouches and the like. Another example of such an organizer is disclosed in U.S. Pat. No. 6,193,118 to Kearl, issued Feb. 27, 2001, that has a work surface that can be used as an erasable writing surface, pockets for storing various items and an organizer tray for writing implements such as crayons.

The art has also provided various types of planning devices. For example, U.S. Pat. No. 2,941,314 to Schwieger, issued Jun. 21, 1960, discloses a room planner comprising a box provided with sheets of grid paper 50 and furniture models 58. Another example is the planning and toy assemblies kit of U.S. Pat. No. 5,505,620 to Barlett issued Apr. 9, 1996, that has receiving surfaces 12 and a plurality of planning elements 14A, 14B and 14C adherable by magnetic attraction to these receiving surfaces. A further example disclosed in U.S. Pat. No. 6,379,156 to Laravea et al, issued Apr. 30, 2002, is an organizer for strategizing team play comprising a plurality of pages bound in a ring binder, including a magnetic surface and player pieces.

While these prior organizer systems and devices provide certain benefits, there is still a need for an improved organizer system that not only provides those benefits, but additionally provides a system with additional components, options and flexibility needed to organize, plan, store, transport and display the items that the user determines are necessary for the development or management of a specific task, job or project, or a non-specific task, job or project. Although these tasks, jobs or projects can be very different, such as, for example, decorating, wedding planning, gardening, landscaping, accounting, business and office management, athletic coaching and management, and the like, these systems and options need to be able to accommodate a number of different aspects, including storing and organizing various materials, such as samples, floor plans, receipts, pictures, and phone numbers; providing the ability to plan various activities and how various items are to be arranged, such as, for example, a work or writing surface, as well as displaying various materials or objects; holding and carrying personal items such as keys, waterbottle, and portable phone, while allowing for easy and convenient transportation. Such a multipurpose organizer system should also permit the components to be used separately, in combinations of only selected components, or all components together.

There is also a need for such systems and options that are directed and tailored for specific tasks, jobs and projects. For example, an organizing system for decorating needs to be easy to carry from home or office to the car, to the store and back, hold, store and organize items that are accumulated and needed for the decorating project, provide the ability to display these items in a manner that makes it simple to work with and compare to other items one may wish to purchase, provide a surface for planning room and furniture layouts, as well as accommodate other components of the organizer system such as replacing the need for a purse when shopping to permit everything be transported in a carry bag that also holds keys, wallet, etc. In the case of an organizing system for wedding planning, it would be desirable to display choices for easy coordination of color and theme, provide a surface with a writing pad for notes or comments, provide pockets for separate aspects of the wedding such as guest lists, addresses, flowers, etc., and provide the ability to have the components of the system to be carried in a fashionable, lightweight, non-bulky, sturdy bag that can stand upright, can be hung on the user's shoulder, and again eliminate the need for a purse. When the organizer is to be used for managing and coaching athletics, it would be desirable to provide an organizer that holds, stores and organizes papers, phone numbers, contracts, rosters, birth certificates, receipts for equipment, tournament information, schedules and pictures, along with a diagram board of the field to plan and show plays to the athletes, such as a removable and erasable surface to draw plays on, as well as a carrier for these items to be used when traveling to athletic events and practices that is lightweight, durable and convenient to use, and includes a carrybag to hold and transport various personal items such as keys, waterbottle and portable phone, replacing the need for a purse or separate bag. Again, while the task, job or project can have specific requirements that are needed to store, organize, plan, display and transport, the organizer system should also be flexible to be able to accommodate multiple purposes and options.

BRIEF DESCRIPTION OF THE INVENTION

This invention is broadly directed at an organizer system that is capable of accommodating multiple purposes and options, such as planning, storing, transporting and displaying, and which comprises an organizer folder, folder holder and carrier that is useful for various tasks, jobs or projects requiring such a system. This invention is also broadly directed at a unique organizer folder that can be used with, or separately from, the organizer system.

The organizer system comprises, in combination, the following components:

A. an organizer folder having:
  1. a front cover having first and second opposed sides;
  2. a back cover having first and second opposed sides;
  3. optionally at least one page positioned between the front and back covers and having first and second opposed sides;
  4. at least one of the following folder components associated with at least one side of the front cover, the back cover or the at least one page:
    a. a planner comprising:
      (i) a planning diagram associated with the at least one side; and
      (ii) optionally at least one object that is repositionable on the planning diagram;
    b. at least one pocket for storing materials;
    c. at least one writing surface;

B. a self-standing folder holder having a receptacle for receiving at least one folder in a stored configuration; and C. a carrier having:
  1. a receptacle for receiving at least one folder holder in a stored configuration; and
  2. a handle for grasping by the user.

The organizer folder comprises:
  1. a front cover having first and second opposed sides;
  2. a back cover having first and second opposed sides;
  3. optionally at least one page positioned between the front and back covers and having first and second opposed sides;
  4. at least one of the following folder components associated with at least one side of the front cover, the back cover or the at least one page:
    a. a planner comprising:
      (i) a planning diagram associated with the at least one side; and
      (ii) at least one object that is repositionable on the planning diagram;
    b. an erasable writing surface; and
  5. at least one pocket for storing materials and associated with at least one side of the front cover, the back cover or the at least one page.

The organizer system and unique folder of this invention provide a number of benefits for the user thereof. For example, the organizer system provides the flexibility to be used in organizing a variety of tasks, jobs or projects, yet can be tailored for specific areas requiring such organizer systems, including decorating, wedding planning, gardening and landscaping, accounting, office and business management, coaching and managing athletics of various types, and the like. The components of the organizer system can be used separately or together, for example, to replace the need for a separate purse to carry various personal items, such as keys, wallet, portable phone, waterbottle, writing implements and the like. The unique folder of this invention which can also be used with, or separately from, the other components of this organizer system to provide the ability to plan activities and design events or items, such as, for example, a room and floor plan, write down or display information, as well as to store and carry various items, including sample materials, receipts and the like.

DETAILED DESCRIPTION OF THE INVENTION

Figure 1:
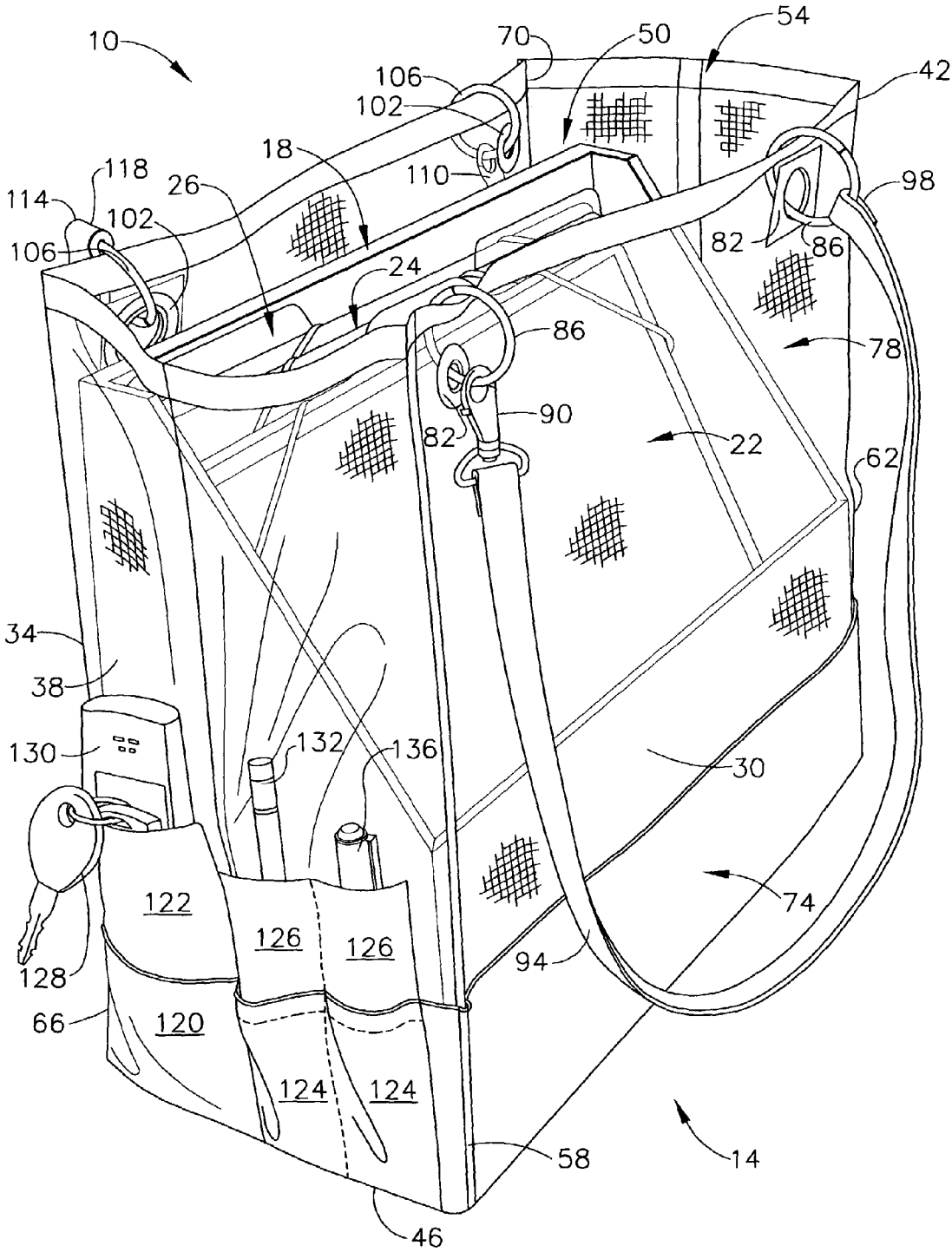
FIG. 1 is a perspective view of an embodiment of the organizer system of this invention.

As used herein, the term "comprising" means various components, steps and the like can be conjointly employed in this invention. Accordingly, the term "comprising" encompasses the more restrictive terms "consisting essentially of" and "consisting of."

The organizer system of this invention is generally useful for a wide variety of tasks, jobs or projects that require a convenient and simple system for organizing, planning, storing, transporting and displaying various items. These tasks, jobs or projects include, but are not limited to, decorating (interior and/or exterior), wedding planning, business and office management, accounting, gardening, landscaping, party planning, coaching and managing athletics, and the like. This organizer system generally comprises three components: (1) an organizer folder; (2) a folder holder for receiving at least one folder; and (3) a carrier for receiving at least one folder holder. The particular construction, composition and configuration of each of these three components will often depend upon the particular task involved. However, the organizer system of this invention is sufficiently flexible to be useful in handling and accommodating any of the previously described tasks, jobs or projects, as well as any other task, job or project.

The organizer folder component generally comprises the following: (1) a front cover; (2) a back cover; (3) optionally at least one page positioned between the front and back covers; and (4) at least one of the following components associated with at least one side or surface of the front cover, the back cover or the at least one page: (a) a planner; (b) at least one pocket for storing materials; (c) at least one writing surface. The front or more typically back cover of the organizer folder can have a tab so that the folder can be identified (e.g., by writing or other indicia). The front and back covers can also be made of a material that allows for the surfaces or sides thereof to be written on, or to have materials adhered thereto, such as for identification purposes. Typically, the organizer folder will comprise a plurality of pages positioned between the front and back covers, the particular number of pages depending upon needs of the particular task, job or project involved, as well as the number of organizer folders that are used with the organizer system.

While the planner, pockets and/or writing surface can be associated with the sides of the front and/or back covers of the organizer folder, they are more typically associated with one or more sides of the pages positioned therebetween. The organizer will also typically include various combinations of these items, for example, a planner with pockets, a writing surface with pockets, or the combination of a planner, pockets and writing surface. These items can be arranged in any order desired by the user depending on the particular task, job or project involved, and can be associated with different pages, with the same page but different sides, or on the same side of the same page. Also, more than one planner, writing surface, and usually more than one pocket can be included in the organizer folder. Besides, the planner, pocket and/or writing surface, the organizer folder can have other items associated with it for accomplishing or handling a specific task, job or project, such as an address book, calendar, place to record contacts, etc.

The planner generally comprises a planning diagram and optionally, but typically, at least one object, more typically a plurality of objects, that is repositionable on the planning diagram. This object(s) can be of a defined recognizable shape or characteristic (e.g., to represent furniture in the case of a decorating organizer system) or can be of undefined shape or characteristic to provide flexibility in use. This object(s) is releasably secured to the planning diagram, or a surface (e.g., transparent surface) overlaying the planning diagram by any suitable manner or method, including but not limited to magnetic attraction (e.g., the planning diagram, or more typically the backing sheet or structure, or the cover/page that underlies the planning diagram, can be made out of metal such as steel while the object(s) has attached thereto or otherwise associated therewith a magnet), Velcro, temporary adhesive materials, or any other suitable device, technique or method for temporarily securing or otherwise associating the object(s) to or with the planning diagram. The planning diagram can be of any desired configuration or shape needed for the particular task, job or project involved, and can be permanently attached to or associated with the folder, or can be removable therefrom.

The pocket, and more typically plurality of pockets, can be of any shape, size or number as required or desired by the particular task, job or project involved. The pocket(s) can also be arranged in any desired order, configuration, or number with the respective sides of the covers, or more typically pages. For example, one pocket can be associated with the cover/page or a plurality of pockets can be associated with the cover/page. The pocket(s) can be formed in any suitable manner and can be of a suitable type, including but not limited to, accordion file-type pockets, pockets secured by a variety of methods and devices, including button closures, snaps, Velcro, magnets and the like, a single pocket or plurality of pockets formed from a single piece or sheet of material, including the material from which the page is made of, where the perimeter of each pocket is demarcated during formation thereof by stitching, sewing, heat (e.g., in the case of thermoplastic materials), or any combination of such techniques.

The writing surface can be in a variety of forms, including but not limited to, a pad of paper comprising a plurality of sheets or an erasable board, such as a board having a dry erasable surface, with or without a diagram or other indicia. The pad of paper can be of any suitable configuration, shape or material for the task, job or project that the organizer is used with. The pad can have any number of sheets of paper associated therewith. The sheets of paper can be plain, lined, with grids, with diagrams, or any other suitable indicia, and can comprise any combination thereof.

The folder holder component has a receptacle for receiving one or more folders for storage. The folder holder can also be provided with the capability to store other desired items for use, such as an address book, calculator, magazines, other books, samples, etc. The folder holder can also be constructed and/or configured from rigid or semi-rigid materials such that it is self-standing. The folder holder can be of any suitable configuration or shape so long as it is capable of receiving at least one folder, and can be provided with pockets or other suitable recesses for storing or securing other items besides the folder(s). The folder holder can also be constructed or configured in a suitable manner such that identifying indicia on the folder(s), e.g., a tab at the top thereof, are readily visible, such as by making the front of the folder holder of transparent material, or by making the front of the folder shorter than the back thereof. The folder holder can also be provided with a handle for grasping by the user for carrying it (including over the shoulder), or for making it easier to remove from the carrier, can be combined with a carry bag for carrying it, and can be provided with one or more pockets for storing or carrying various items such as a phone or address book.

The carrier has a receptacle for receiving one or more folder holders for storage therein and a handle for grasping by the user for transporting the carrier, with or without the folder holder(s) and/or folder(s). The carrier can be constructed or configured of materials such that it is rigid, semi-rigid, flexible or any combination thereof, and can be constructed or configured to be self-standing, with or without receiving or containing the folder holder(s) and/or folder(s). For example, the upper or top portion of the carrier can be formed from a flexible mesh material, while the lower or bottom portion of the carrier is formed from a rigid or semi-rigid opaque material (e.g., leather or vinyl), with or without reinforcement to make the carrier self-standing. The carrier can be in a variety of forms, shapes or styles and can be constructed to be aesthetically pleasing. For example, the carrier can be in the form of a fashionable carry bag that stands upright when it contains the folder holder(s) and/or folder(s), and is provided with reinforced straps that can be carried by the user on their shoulder. The carrier can also be provided with one or more pockets, recesses or other receptacles of similar or differing sizes for storing and securing items other than the folder holder(s), such as portable phones, waterbottle, pens, pencils, markers, tape measure, calculator or any other implement deemed necessary by the user when working on the task, project, or job, as well as keys, wallet, checkbook, etc. If desired, the carrier can be combined with the folder holder to provide a single unit for holding and carrying folders.

The various embodiments of this invention are further illustrated by reference to the drawings as described hereafter. While the following discussion will be generally with reference to an organizer system for use in a decorating task, job or project, it should be understood that this organizer system can be modified as appropriate to be suitable for use with other tasks, jobs and projects.

Referring to the drawings, FIG. 1 shows an embodiment of the organizer system generally indicated as 10. System 10 is shown as comprising a carrier in the form of shoulder bag indicated as 14, folder holder indicated generally as 18 received by and within bag 14, and a plurality of folders indicated generally as front organizer folder 22, intermediate organizer folder 24 and back organizer folder 26 that are received by and within folder holder 18. Although not shown, bag 14 and folder holder 18 can be provided with a mechanism for releasably securing folder holder 18 within bag 14, such as by complementary snap fasteners.

As shown in FIG. 1, bag 14 has a front vertical panel indicated generally as 30, a back vertical panel indicated generally as 34 spaced from front panel 30, and a pair of spaced apart side vertical panels 38 and 42 connected to the front and back panels, and a bottom horizontal panel 46 connected to the front, back and side panels. Panels 30, 34, 38, 42, and 46 which are each generally rectangular in shape also define an interior compartment or receptacle for bag 14 indicated generally as 50 having a generally rectangular opening 54 at the top thereof. Although not shown, bag 14 can be provided with a fold-over flap proximate the top thereof, or other form of closure for securing the contents of bag 14 within receptacle 50. Front panel 30 and side panels 38 and 42 intersect and are connected, respectively, at vertical edges 58 and 62, while back panel 34 and side panels 38 and 42 intersect and are connected, respectively, at vertical edges 66 and 70. Bag 14 has a lower portion indicated generally as 74 and an upper or top portion indicated generally as 78. As shown in FIG. 1, lower or bottom portion is formed of a generally solid or opaque material such as leather or vinyl and provides relatively a stiff or rigid base so that bag 14 is self-standing, especially when it contains folder holder 18 with folders 22, 24 and 26. Upper portion 78 is shown in FIG. 1 as being made of a mesh-type material that is relatively strong but lightweight so that bag 14 is relatively sturdy, yet easy to carry.

As also shown in FIG. 1, a pair of grommets indicated generally as 82 are secured in front panel 30, one proximate each edge 58 and 62 and also proximate opening 54. One of a pair of rings 86 are received by each grommet 82, with one of the rings 86 receiving and securing a clasp 90 at one end of strap 94, the other ring receiving and securing a loop 98 at the other end of strap 94. As also shown in FIG. 1, a pair of grommets indicated generally as 102 are secured in back panel 34, one proximate each edge 66 and 70 and also proximate opening 54. One of a pair of rings 106 are received by each grommet 102, with one of the rings 102 receiving and securing a clasp 110 at one end of strap 114, the other ring receiving and securing a loop 118 at the other end of strap 114. Together, straps 94 and 114 form the handle or shoulder strap for carrying bag 14. As also shown in FIG. 1, larger lower and upper pockets 120 and 122, as well as a pair of respective upper and lower smaller pockets 124 and 126 are provided that are formed in or otherwise associated with side panel 38. Larger objects such as a keys 128 and a portable phone 130 can be received and stored within pockets 120/122, while smaller objects such as pencil 132 and pen 136, can be received and stored within pockets 124/126.

Figure 2:
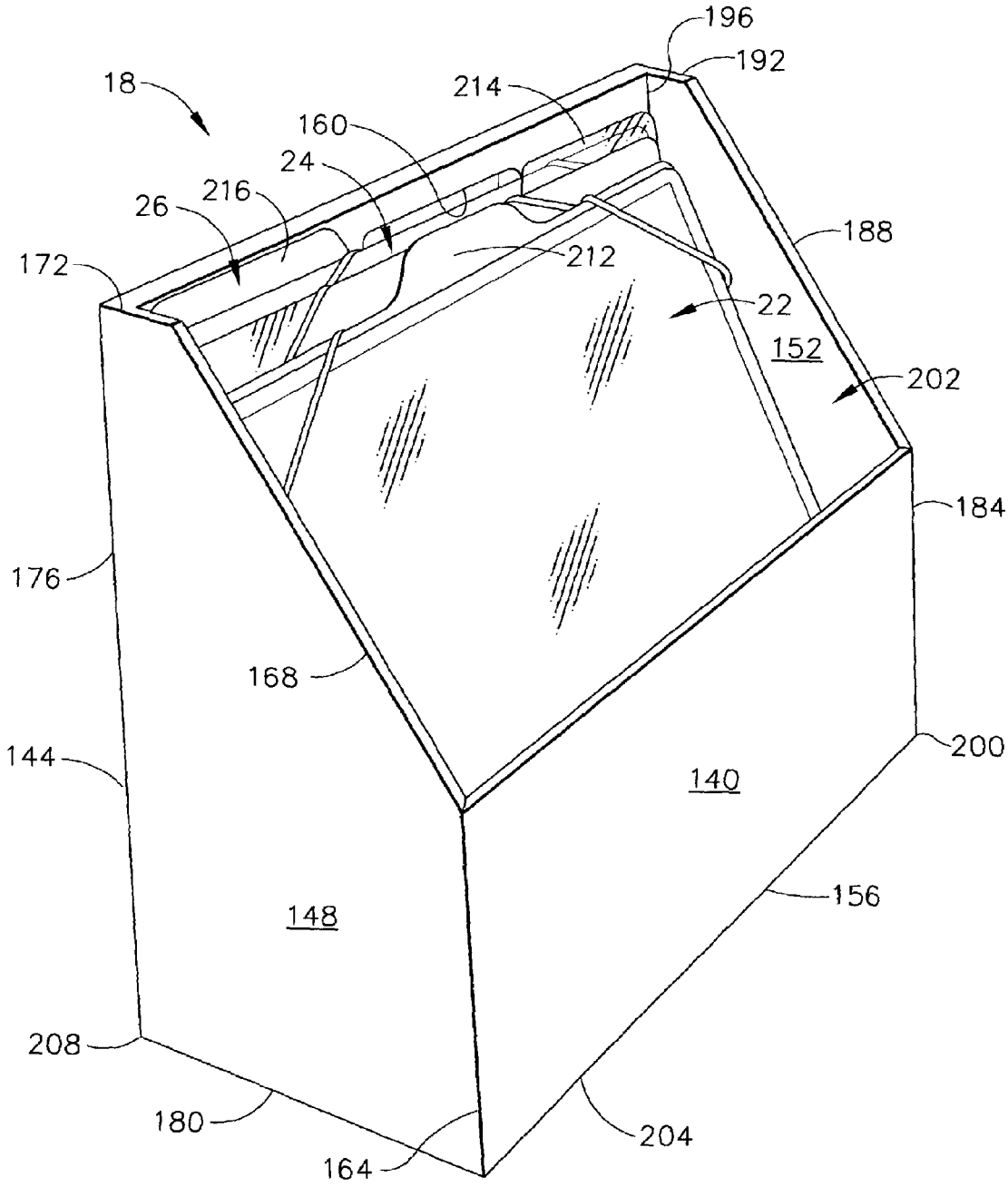
FIG. 2 is a perspective view of an embodiment of the folder and folder holder components of the organizer system of FIG. 1.

An embodiment of folder holder 18 is shown in FIG. 2 with folders 22, 24 and 26 being received and stored therein. As shown in FIG. 2, folder holder 18 has a front vertical panel indicated generally as 140, a back vertical panel indicated generally as 144 spaced from front panel 140, a pair of spaced apart side vertical panels 148 and 152 connected to the front and panels, and a bottom horizontal panel 156 connected to the front, back and side panels. Panels 140, 144, 148, 152 and 156 are typically constructed of relatively rigid materials so that folder holder 18 is self-standing, with or without folders 22, 24 and 26. Folder holder 18 can also be provided with a handle for grasping it, such as in the form of the elongated aperture or slot indicated generally as 160 that is formed in back panel 144. This handle 160 allows folder holder 18 to be easily carried by the user or lifted easily from bag 14.

As shown in FIG. 2, panels 140, 144 and 156 are each generally rectangular in shape or configuration. As also shown in FIG. 2, side panel 148 has a front vertical edge 164 that intersects and connects with front panel 140, and a diagonal edge 168 that extends upwardly and rearwardly from the top end of edge 164 to the front end of top horizontal edge 172. Top edge 172 of side panel 148 extends rearwardly to back vertical edge 176 such that side panel 148 intersects and connects to back panel 144. Side panel 148 also has a bottom horizontal edge 180 that extends rearwardly from edge 164 to edge 176, and intersects and connects side panel 148 to bottom panel 156. Similarly and as also shown in FIG. 2, side panel 152 has a front vertical edge 184 that intersects and connects with front panel 140, and a diagonal edge 188 that extends upwardly and rearwardly from the top end of edge 184 to the front end of top horizontal edge 192. Top edge 192 of side panel 152 extends rearwardly to back vertical edge 196 such that side panel 152 intersects and connects to back panel 144. Side panel 152 also has a bottom horizontal edge 200 that extends rearwardly from edge 184 to edge 196, and intersects and connects side panel 152 to bottom panel 156.

Panels 140, 144, 148, 152 and 156 together define an interior compartment or receptacle indicated generally as 202 for receiving and storing folders 22, 24 and 26. As shown in FIG. 2, the height of front panel 140 that extends upwardly from the front horizontal edge 204 of bottom panel 156 is less than that of back panel 144 that extends upwardly from back horizontal edge 208 of bottom panel 156. As a result, the upper portions of folders 22, 24 and 26 are visible so that the user can see indicia thereon, such as that on the upper tabs 212, 214 and 216, respectively, of folders 22, 24, and 26. For example, tabs 212, 214 and 216 can have labels attached thereto with indicia written thereon.

Figure 3:
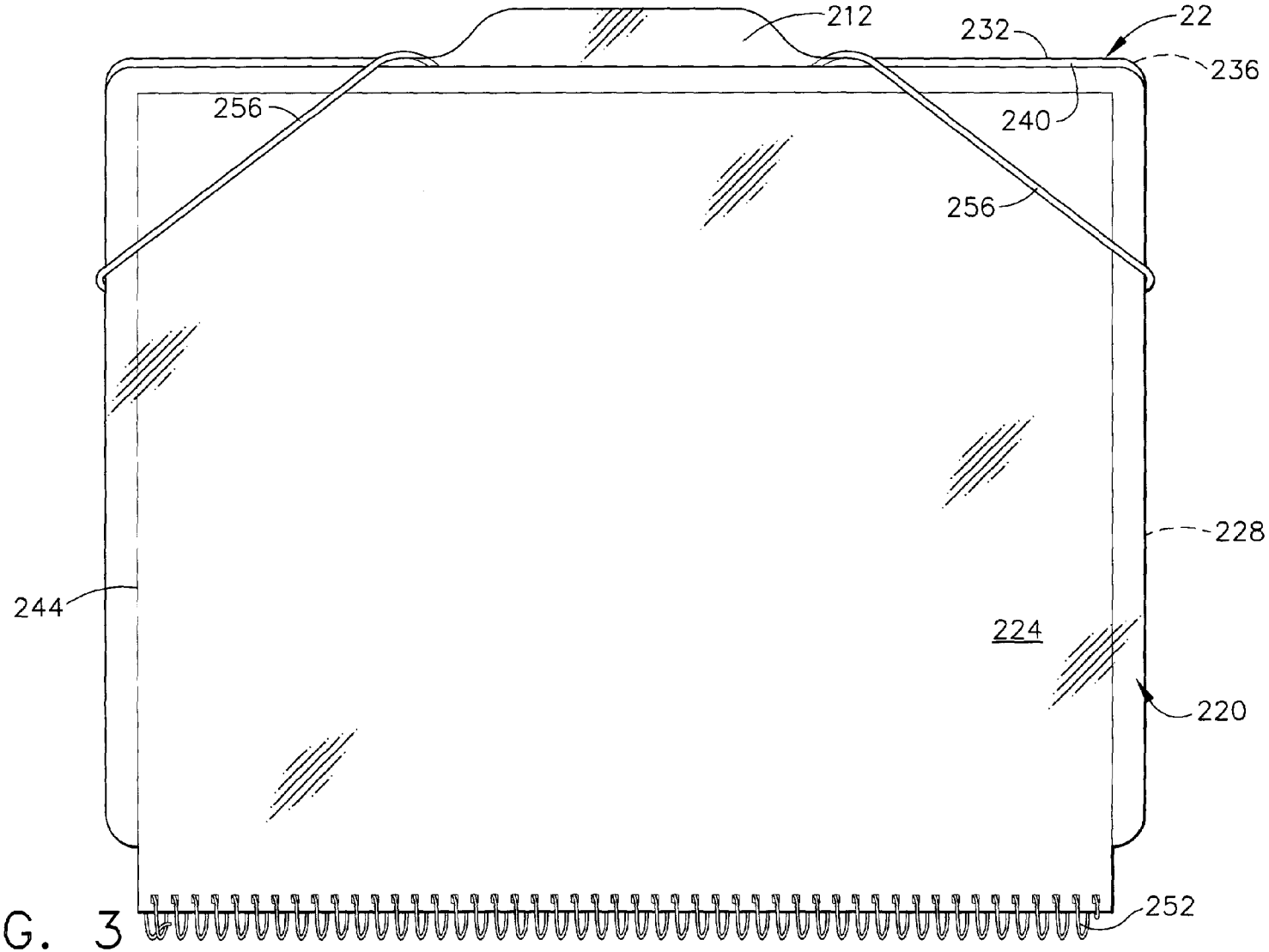
FIG. 3 is a plan view of an embodiment of the folder of FIG. 2 in a closed configuration.

An embodiment of folder 22 in a closed configuration is shown in FIG. 3. As shown in FIG. 3, folder 22 has front generally rectangular cover indicated as 220 having an outer side or surface 224 and an inner side or surface 228, and back generally rectangular cover indicated as 232 having an outer side or surface 236 and an inner side or surface 240. Covers 220 and/or 232 can be made of opaque material, or transparent or translucent (e.g. frosted) materials and then provided with backing sheets having decorative patterns, coloring and/or identifying indicia that are visible through covers 220 and 232. One such backing sheeting for cover 220 is indicated as 244. Covers 220 and 232 can also be made of materials, such as high density polyethylene (HDPE) or other suitable materials, that allow for their respective outer surfaces 224 and 236, as well as inner surfaces 228 and 240, to be written or marked on. As shown in FIG. 3, front and back covers 220 and 232 are joined together at an edge by any suitable binder such as spiral binder 252. Folder 22 can be held in this closed configuration by any suitable device or mechanism, such as, for example, elastic straps indicated generally as 256.

Figure 4:
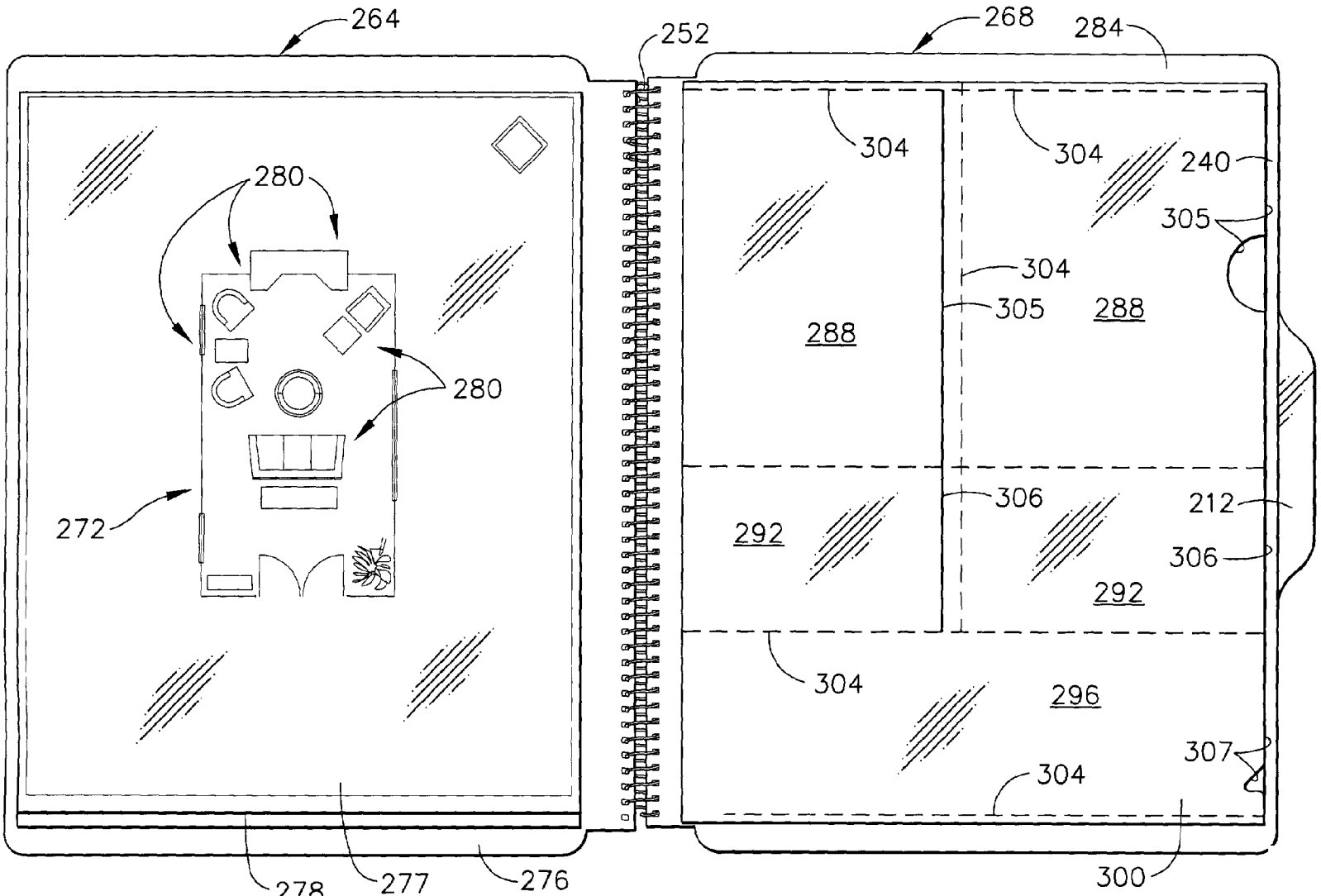
FIG. 4 is a plan view of the folder of FIG. 3 in an open configuration showing an embodiment of two adjacent pages therein.

Positioned between front cover 220 and back cover 232 are one or more pages. One embodiment of two of these adjacent pages when folder 22 is in an open, flat configuration is shown in FIG. 4 and are indicated as 264 and 268, respectively, that can be made out of any suitable material, such as HDPE, and are also secured to folder 18 along one edge thereof by binder 252. Generally rectangular page 264 is shown in FIG. 4 as having a planning diagram in the form of a room diagram indicated generally as 272 that is associated with the back side or surface 276 of page 264. This planning diagram 272 can be permanently associated with surface 276 or can be releasably secured thereto so that planning diagram 272 is interchangeable with other planning diagrams, such as by providing a transparent sheet indicated as 277 that overlays diagram 272 and has an opening such as a slot indicated as 278 at the edge of sheet 277 for insertion or removal of diagram 272. Planning diagram 272 is also shown as having a plurality of repositionable objects in the shape and configuration of various furniture pieces indicated collectively as 280. These furniture pieces are releasably secured to or associated with planning diagram 272 by any suitable mechanism, such as by associating or attaching to each of the furniture pieces a magnet and making the planning diagram 272 out of relatively thin metal, e.g., steel, that attracts the magnets, or by making the diagram 272 out of a nonmagnetic material such as paper, plastic (e.g., transparent plastic) or the like, but providing an underlying backing sheet or other structure made out of a material that attracts the magnets, and which extends underneath the entire surface of diagram 272, or only under selected portions of the surface of diagram 272. This backing sheet or structure can also be inserted into the previously described slot formed by a transparent overlaying sheet on surface 276, can be attached or otherwise associated with surface 276, or can be used in place of page 264, if desired.

Generally rectangular page 268 adjacent page 264 is shown as having a front side or surface 284 provided with a plurality of larger size pockets indicated generally as a pair of vertically adjacent generally rectangular pockets 288, a plurality of smaller size pockets indicated generally as a pair of vertically adjacent generally rectangular pockets 292, and a relatively long and relatively thin generally rectangular pocket indicated generally as 296. Pockets 288, 292 and 296 are shown in FIG. 3 as being formed from a single piece of transparent flexible material, such as polypropylene or vinyl, indicated generally as 300 that has holes indicated generally as 304 stitched or formed therein to define the perimeter of the respective pockets when material 300 is secured to surface 284 of page 268. While pockets 288, 292 and 296 are shown as having rectangular shapes, particular orientations, and differing sizes or configurations, it should be understood that these pockets can have other shapes, can be oriented in other ways, and can have the same or similar sizes or configurations, if desired. These pockets are also provided with respective openings indicated as 305, 306 and 307 to receive and store a variety of items or materials of differing sizes, shapes, configurations and type, such as, for example, material samples, receipts, specifications, descriptions and the like.

Figure 5:
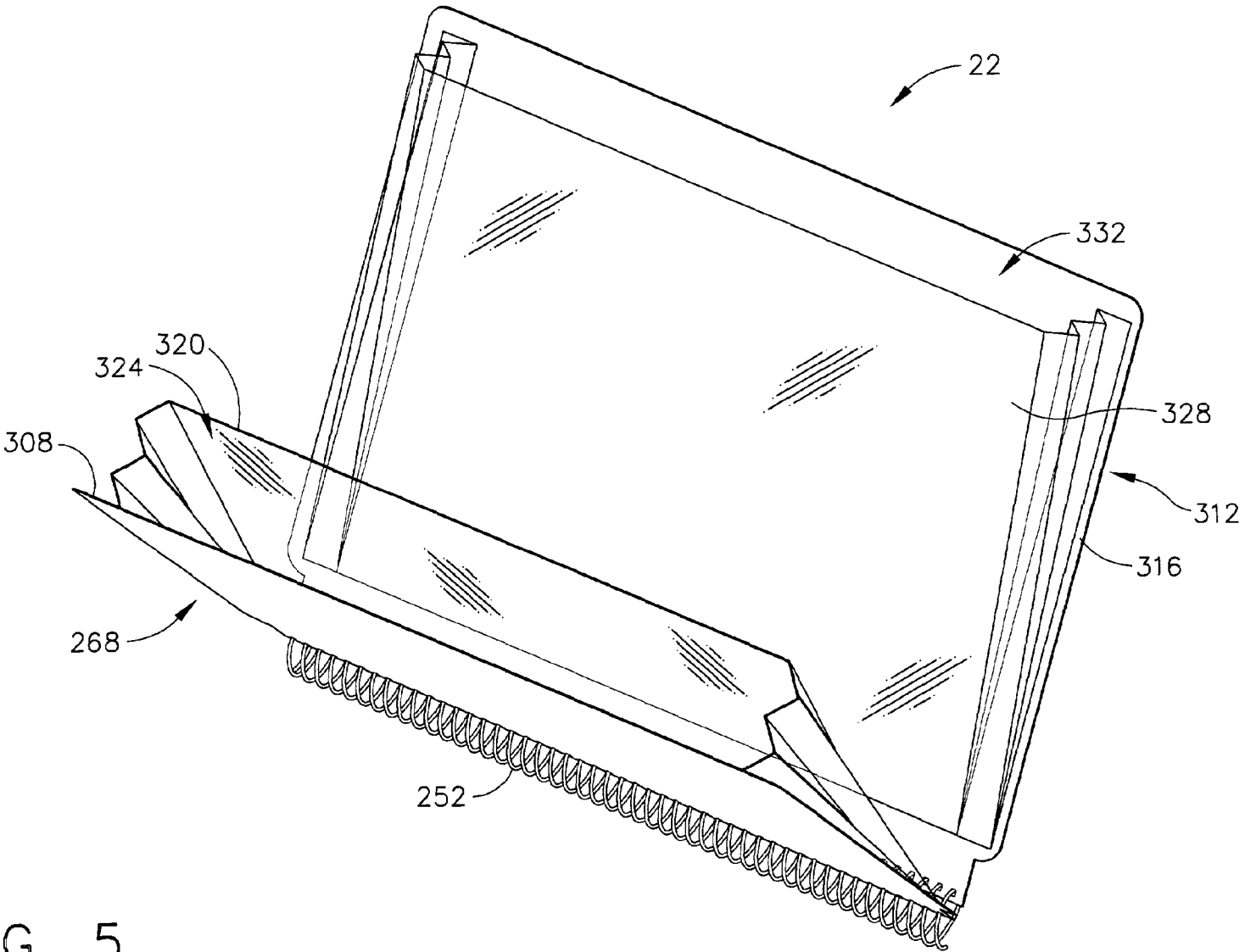
FIG. 5 is a perspective view of the folder of FIG. 3 in an open configuration showing an embodiment of the back side or surface of one of the pages in FIG. 4 and an embodiment of the front side or surface of another adjacent page.

FIG. 5 shows the back side or surface of page 268 that is indicated generally as 308 that is adjacent to another page indicated generally as 312 and having a front side or surface indicated generally as 316. Attached or otherwise associated with back surface 308 of page 268 is an accordion file indicated generally as 320 having an opening 324 at the top thereof to receive items or materials to be stored of differing sizes, shapes, configurations and type, such as, for example, material samples, receipts, specifications, descriptions and the like. Attached or otherwise associated with front surface 316 of generally rectangular page 312 is another accordion file 328 having an opening 332 at the top thereof to also receive items or materials to be stored of differing sizes, shapes, configurations and type. Accordion files 320 and 328 can also be provided with a mechanism (e.g., Velcro) to hold the file in a closed configuration so as to secure the contents within the respective files.

Figure 6:
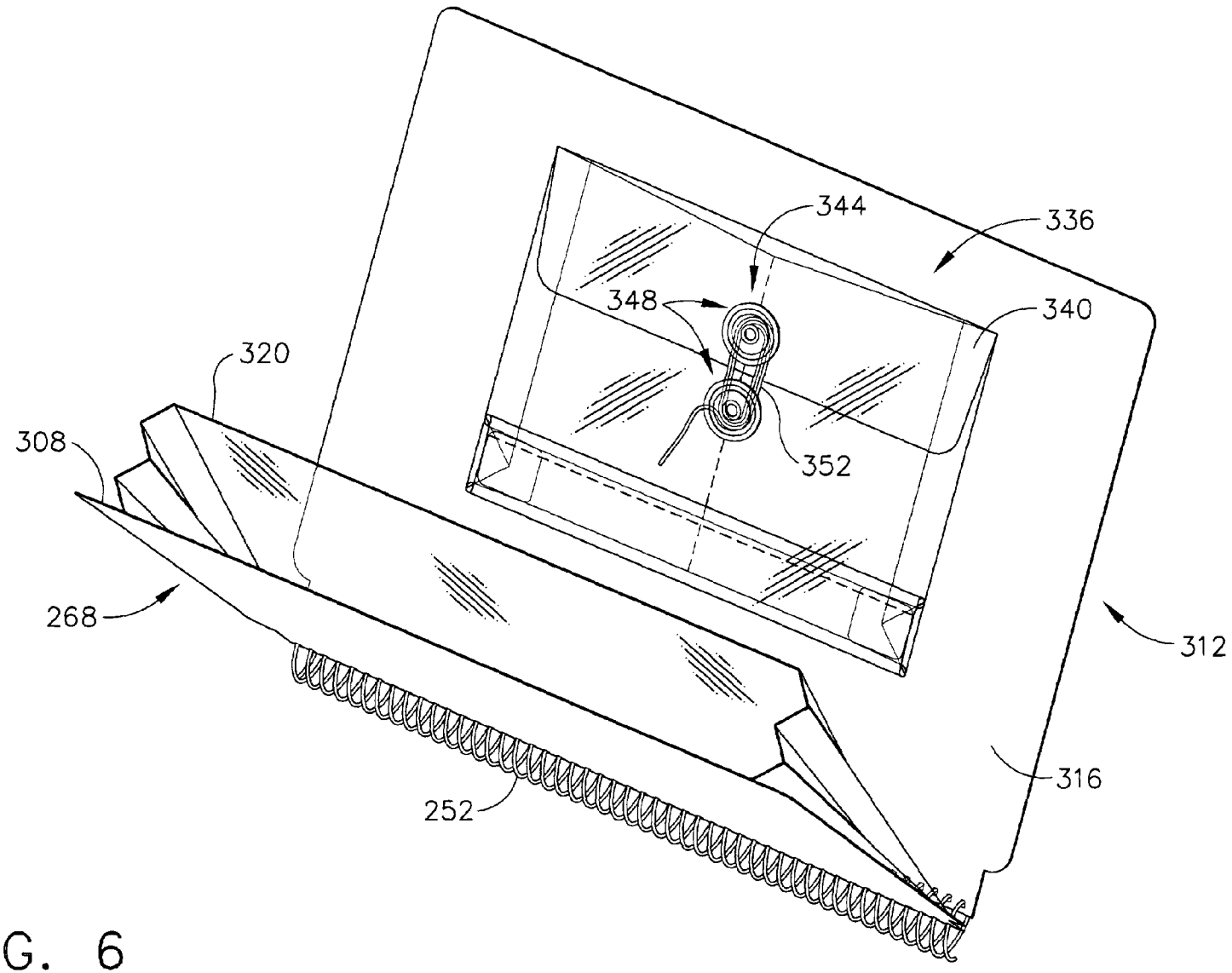
FIG. 6 is a perspective view of the folder of FIG. 3 in an open configuration showing an alternative embodiment of the front side or surface of the other adjacent page shown in FIG. 5.

An alternative embodiment to page 312 in FIG. 5 is shown in FIG. 6. As shown in FIG. 6, a button closure file indicated generally as 336 has been substituted for accordion file 328. This button closure file 336 that is attached or otherwise associated with front surface 316 of page 312 comprises an upper closure or flap indicated generally as 340 that is hinged for folding over to secure the contents within file 336. File 336 also comprises a button closure indicated generally as 344 that has a pair of spaced apart circular tabs indicated generally as 348, and a tie indicated as 352 for securing the button closure 344.

Figure 7:
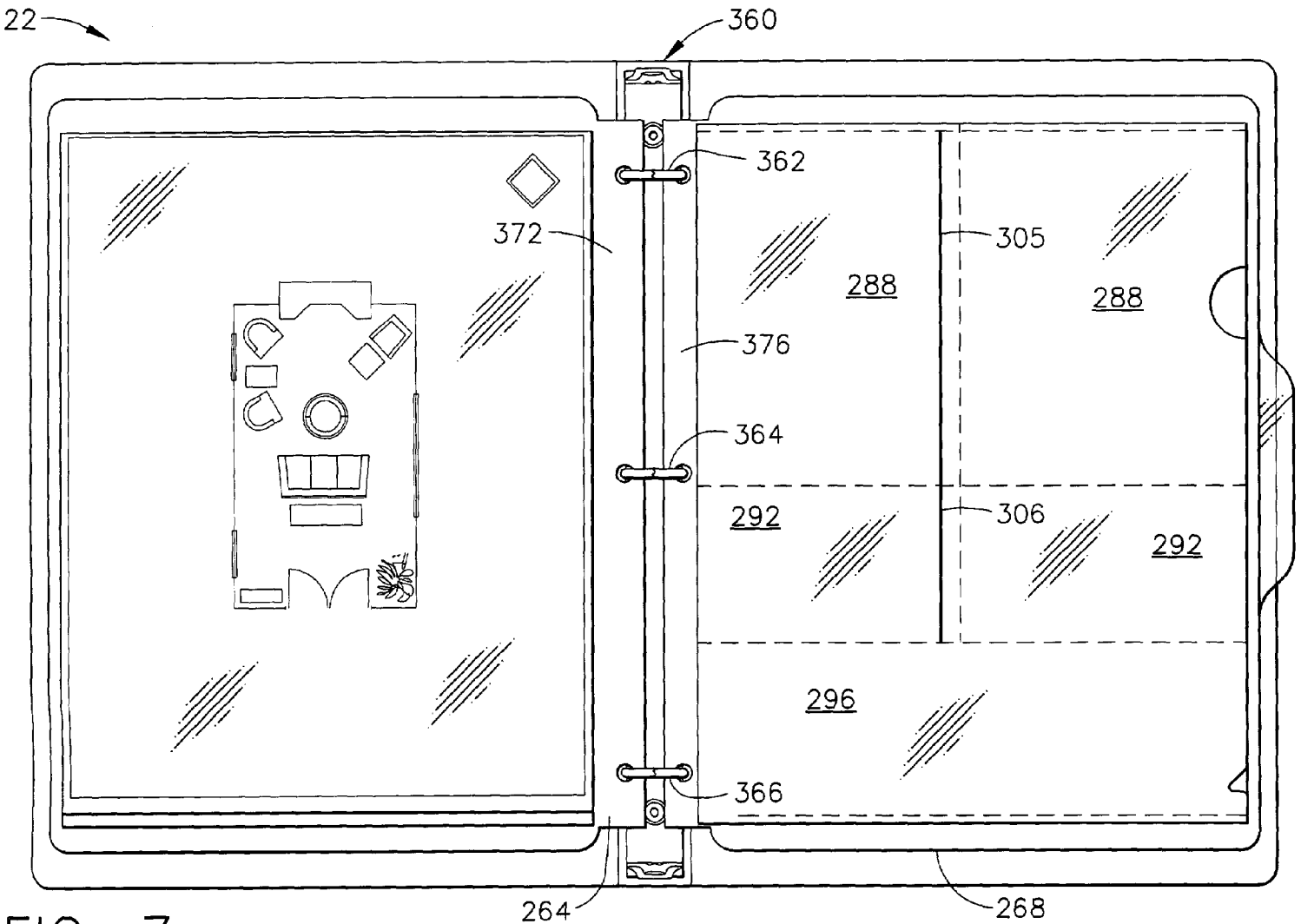
FIG. 7 is a plan view of an alternative embodiment of the folder of FIG. 4 in an open configuration.

An alternative embodiment to folder 22 of FIG. 4 is shown in FIG. 7. As shown in FIG. 7, folder 22 is in the form a three-ring notebook having a binder indicated generally as 360 for releasably securing pages 264 and 268. Binder 360 has an outer ring closure indicated generally as 362, an inner ring closure indicated generally as 364 and another out ring closure indicated generally as 366 for releasably securing pages 264 and 268 along respective inner edges 372 and 376.

The organizer system of this invention can also be provided with a set of instructions that are written or printed on the packaging that the organizing system is sold or distributed in, or on a sheet(s) of paper separately therefrom, or associated with the organizer system, e.g. as one of the pages included with folders 22, 24 or 26. For example, the set of instructions can be written or printed on the outside or inside of the organizer itself, or can provided as a separate sheet(s) that is attached to or inserted within the organizer. Alternatively, the organizer can be provided with software (e.g., on a floppy disk(s) or CD ROM disk(s)) that provides instructions for how to use the organizer system and its various components.

While specific embodiments of the method of the present invention have been described, it will be apparent to those skilled in the art that various modifications thereto can be made without departing from the spirit and scope of the present invention as defined in the appended claims.

What is claimed is:

1. An organizer folder, which comprises:

1. a front cover having first and second opposed sides;
2. a back cover having first and second opposed sides;
3. a plurality of pages positioned between the front and back covers, each page having first and second opposed sides;
4. a task, job or project planner, the planner comprising:
   a. a task, job or project planning diagram attatched to one side of one page of the plurality of pages; and
   b. at least one object attached to the folder that is repositionable on the planning diagram;
5. at least one pocket for storing materials which is attached to at least one side of a different page of the plurality of pages.

2. The folder of claim 1 wherein the planner is a room planner, a decorating planner, a wedding planner, a business and office management planner, an accounting planner, a gardening planner, a landscaping planner, a party planner, or a coaching and managing athletics planner.

3. The folder of claim 2 wherein the planner comprises a plurality of repositionable objects, each of which has a recognizable shape.

4. The folder of claim 3 wherein the repositionable objects are each releasably secured to the planning diagram by magnetic attraction.

5. The folder of claim 1 which comprises a plurality of pockets associated with the one side of the one page.

6. The folder of claim 5 wherein at least one additional pocket is associated with the other side of the one page or one side of a different page.

7. The folder of claim 6 wherein the at least one additional pocket is associated with the one side of the one page or the one side of a different page is an accordion file.

8. The folder of claim 1 which further comprises a pad of paper having a plurality of sheets.

9. The folder of claim 1 which further comprises an erasable board having a dry erasable writing surface associated with at least one side of the front cover, the back cover or the at least one page.

10. The folder of claim 3 wherein the planner is a room planner comprising a room planning diagram and a plurality of furniture pieces that are repositionable on the room planning diagram.

* * * * *